US008197030B1

(12) United States Patent
Chen et al.

(10) Patent No.: US 8,197,030 B1
(45) Date of Patent: Jun. 12, 2012

(54) FLUID EJECTOR STRUCTURE

(75) Inventors: Chien-Hua Chen, Corvallis, OR (US); Timothy L. Weber, Corvallis, OR (US); Sam G. Angelos, Jr., Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 768 days.

(21) Appl. No.: 12/357,723

(22) Filed: Jan. 22, 2009

Related U.S. Application Data

(63) Continuation-in-part of application No. 12/205,709, filed on Sep. 5, 2008, now Pat. No. 8,109,607.

(60) Provisional application No. 61/035,223, filed on Mar. 10, 2008.

(51) Int. Cl.
*B41J 2/14* (2006.01)
*B41J 2/15* (2006.01)

(52) U.S. Cl. ..... 347/50; 347/40; 347/47

(58) Field of Classification Search ..... 347/40, 347/47, 50, 58
See application file for complete search history.

(56) References Cited

U.S. PATENT DOCUMENTS 6,491,376 B2 * 12/2002 Trauernicht et al. ..... 347/47
6,663,221 B2 * 12/2003 Anagnostopoulos et al. .. 347/40

* cited by examiner

*Primary Examiner* — Geoffrey Mruk

(57) ABSTRACT

In one embodiment, a fluid ejector structure includes an array of fluid ejector elements; an array of fluid ejection orifices, each orifice in the array positioned adjacent to a corresponding one of the fluid ejector elements; and a three dimensional array of interconnected conductors within the orifice and ejector element arrays. In another embodiment an orifice sub-structure for a fluid ejector structure includes: a substrate; an array of orifices in the substrate arranged in rows in an x direction and in columns in a y direction; and a first thin film structure that includes first conductive elements within the orifice array extending in the x direction and in the y direction.

9 Claims, 12 Drawing Sheets

FLUID EJECTOR STRUCTURE

CROSS REFERENCE TO RELATED APPLICATIONS

This application is a continuation-in-part of U.S. application Ser. No. 12/205,709 filed Sep. 5, 2008 now U.S. Pat. No. 8,109,607 titled Fluid Ejector Structure and Fabrication Method, incorporated herein by reference in its entirety, which claims the benefit of U.S. provisional application Ser. No. 61/035,223 filed Mar. 10, 2008.

BACKGROUND

Thermal inkjet printers typically utilize a printhead that includes an array of orifices (also called nozzles) through which ink is ejected on to paper or other print media. Ink filled channels feed ink to a firing chamber at each orifice from a reservoir ink source. Applied individually to addressable thermal elements, such as resistors, ink within a firing chamber is heated, causing the ink to bubble and thus expel ink from the chamber out through the orifice. As ink is expelled, the bubble collapses and more ink fills the chamber through the channels from the reservoir, allowing for repetition of the ink expulsion sequence.

Many conventional thermal inkjet printheads are currently produced with ink feed channels formed in a semiconductor substrate structure that includes the firing resistors. A barrier layer is formed on the substrate structure and a metal or polyimide orifice plate is attached to the barrier layer. The ink feed channels extend lengthwise along the printhead to carry ink to openings in the barrier layer that direct ink to the resistors. The barrier layer material is often a thick, organic photosensitive material laminated onto the substrate structure, and then patterned and etched with the desired opening and chamber configuration.

The firing resistors are formed in thin film layers in the substrate structure. The barrier layer and orifice plate in conventional printheads are not suitable for circuit integration. Thus, the control and drive circuits enabling the resistors and the conductive traces to bonding pads that provide external electrical connections to the printhead must be laid out along the length of the substrate structure between ink channels in the thin film layers of the substrate structure. Such "two dimensional" configurations take up significant space on the substrate die and present special challenges for efficiently routing conductive traces between the bond pads and the control and drive circuit elements. Also, during printing operations, ink is ejected in a direction perpendicular to the surface of the substrate structure. Again, because the barrier layer and orifice plate in conventional printheads are not suitable for circuit integration, there is no easy way to detect or influence the ink drops in the direction of drop ejection.

DRAWINGS

The structures shown in the figures, which are not to scale, are presented in an illustrative manner to help show pertinent structural and processing features for example embodiments of the disclosure. Due to space limitations and for clarity, in some instances where a structural feature or element occurs multiple times in a figure, fewer than all of the multiple occurrences are indicated by the corresponding part number.

DESCRIPTION

Embodiments of the present disclosure were developed in an effort to increase circuit density and expand functionality in thermal inkjet printheads. Embodiments of the disclosure, therefore, will be described with reference to a thermal inkjet printhead structure. Embodiments may be implemented in composite printhead structures such as those shown and described in application Ser. No. 12/205,709 which enables the formation of thin film and other conductive layers as part of the orifice sub-structure. Embodiments, however, are not limited to such thermal inkjet printhead structures, or even inkjet printhead structures in general, but may be include other fluid ejector structures. Hence, the following description should not be construed to limit the scope of the disclosure.

X, y and z directions or axes in this document refers to the x, y and z axes in a three dimensional Cartesian coordinate system. Thus, it is understood that the x, y and z directions or axes are orthogonal to one another, that a plane defined by two axes is orthogonal to a plane formed by any other two axes, and that one plane formed by two axes is parallel to another plane formed by those same two axes.

Figure 1:
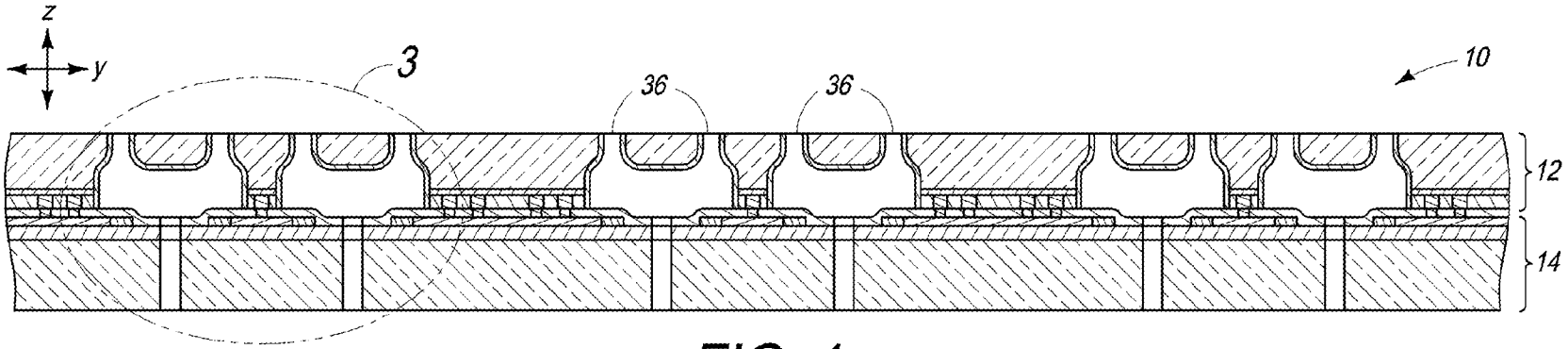
FIGS. 1 and 2 are elevation and perspective section views, respectively, illustrating a thermal inkjet printhead structure according to one embodiment of the disclosure.
Figure 3:
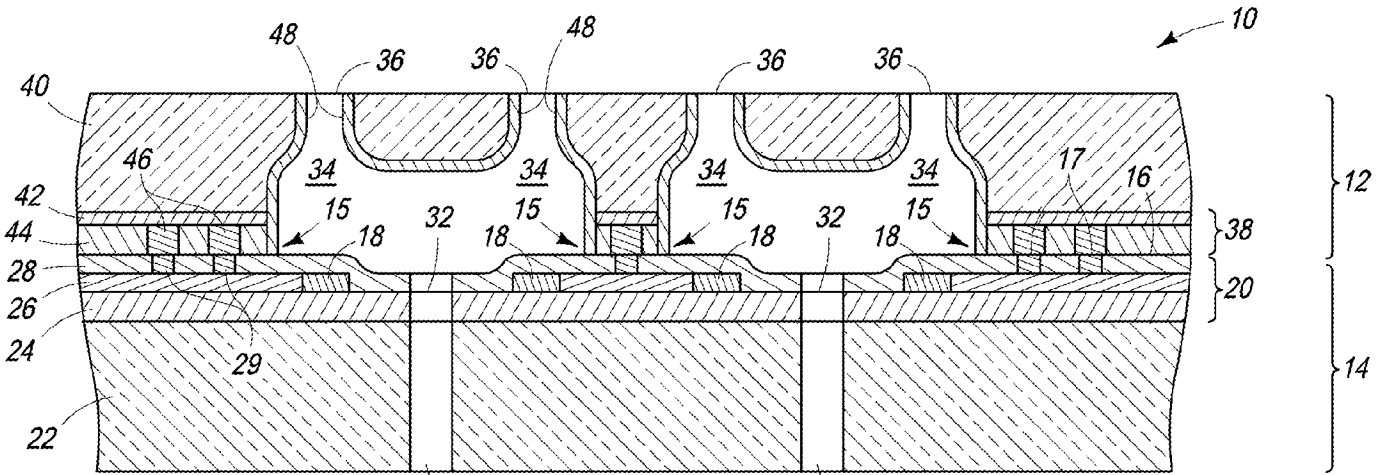
FIG. 3 is a detail section view of a portion of the printhead structure shown in FIG. 1.
Figure 2:
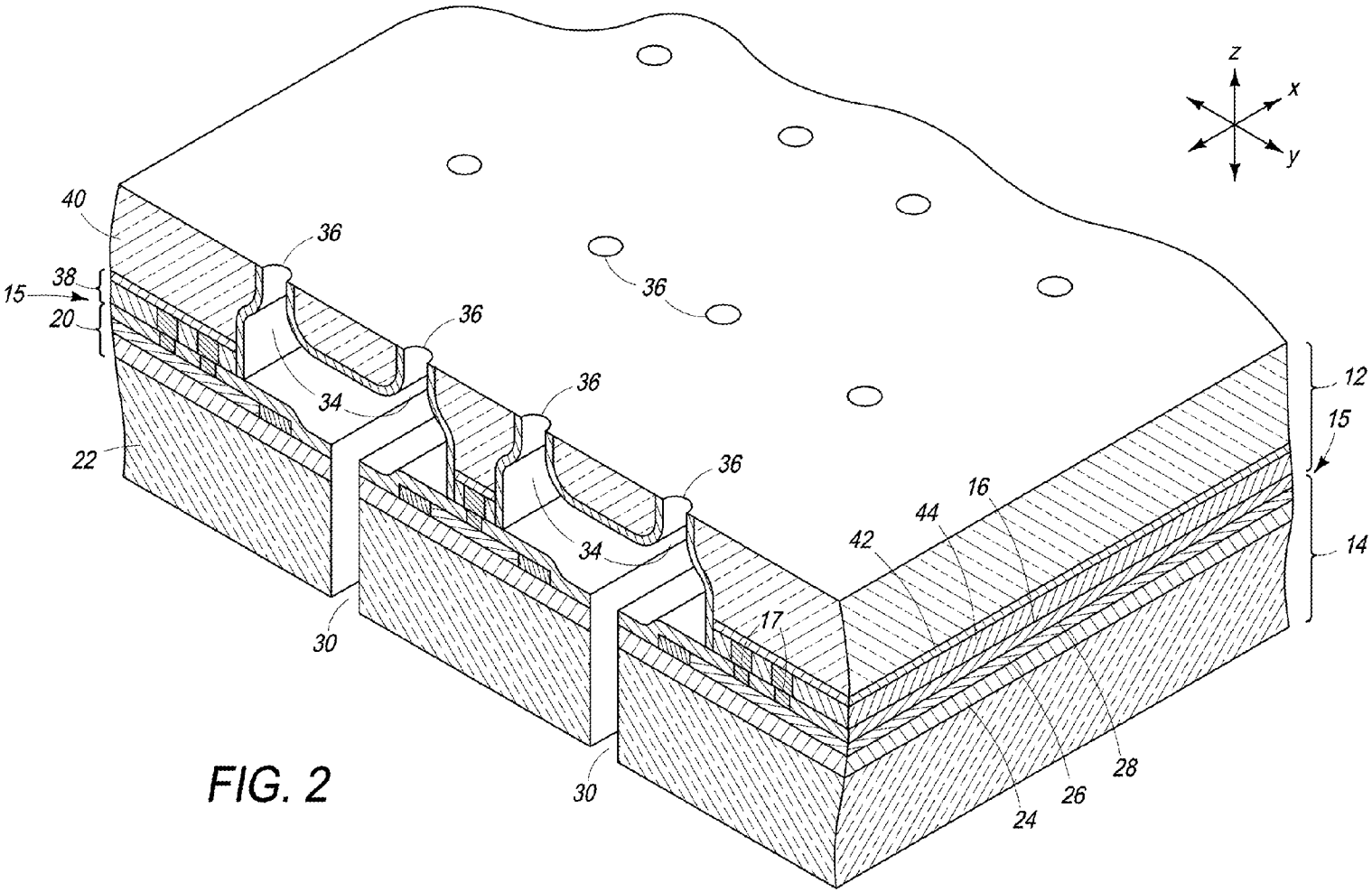

FIGS. 1 and 2 are elevation and perspective section views, respectively, illustrating a thermal inkjet printhead structure 10 according to one embodiment of the disclosure. FIG. 3 is a detail section view of a portion of printhead structure 10 within the circle shown in FIG. 1. For an inkjet printhead structure 10, the fluid (ink) dispensed is a liquid, although a small amount of gas, typically air bubbles, may sometimes be present in the ink. While embodiments are not limited to dispensing ink and other liquids, and may include ejector structures for dispensing other fluids, ejector structures such as those disclosed in this document generally are not practical for dispensing fluids composed primarily of gas(es).

Referring to FIGS. 1-3, printhead structure 10 is formed as a composite structure that includes an orifice sub-structure 12 and an ejector element sub-structure 14 bonded together along an interface 15. Interface 15 includes bonding interface areas 16 where the primary structural bonds are made between elements in sub-structures 12 and 14 and electrical interface areas 17 where electrical connections are made between elements in sub-structures 12 and 14. A direct contact bond may be formed between the two sub-structures 12 and 14 at bonding interface areas 16 using, for example, low temperature plasma activated bonding techniques. Direct contact bonding occurs when two smooth surfaces are brought into direct contact with one another under conditions that allow bonding between the two surfaces at near room temperature. Plasma activation increases the density of the chemical interface species so a robust covalent bond may be achieved at low temperature. Annealing the plasma activated bond increases bond strength. Electrical connections may be made at electrical interface areas 17, for example, using solder, metal compression bonding, or a conductive adhesive.

Firing resistors 18 in ejector element sub-structure 14 are formed as part of a so-called "thin film" structure 20 on a substrate 22. Although a silicon substrate 22 is typical, other suitable substrate materials could be used. In addition to firing resistors 18, thin film 20 in ejector element sub-structure 14 may include control and drive circuits (or circuit elements) for resistors 18, conductive paths for these circuits, and layers/films that electrically insulate the conductors from surrounding structures and help protect against contamination, corrosion and wear (such protection is often referred to passivation). Thus, thin film 20 shown in the figures is a simplified depiction of an actual thin film structure. In the embodiment shown, as best seen in FIG. 3, thin film 20 includes a field oxide layer 24 on substrate 22, conductors 26 to resistors 18, a passivation dielectric layer 28 over resistors 18 and conductors 26, and interconnection conductors 29 through passivation layer 28. Ink supply channels 30 in ejector element sub-structure 14 (including openings 32 through thin film 20) carry ink to firing chambers 34 associated with each firing resistor 18.

Ink drops are expelled or "fired" from each chamber 34 through an orifice 36 in orifice sub-structure 12. Orifice sub-structure 12 includes a thin film structure 38 on a silicon or other suitable substrate 40. Thin film 38 in orifice sub-structure 12 may include control and drive circuits (or circuit elements) for resistors 18, conductive paths for these circuits, and layers/films that electrically insulate the conductors from surrounding structures and help protect against contamination, corrosion and wear (such protection is often referred to passivation). Thus, thin film 38 shown in the figures may reflect a simplified depiction of an actual thin film structure. In the embodiment shown, as best seen in FIG. 3, thin film 38 includes conductors 42 on substrate 40, an insulating layer 44 covering conductors 42, and interconnection conductors 46 through insulating layer 44. Orifice sub-structure 12 may also include a dielectric or other suitable passivation layer 48 along those areas exposed to ink, for example at firing chambers 34 and orifices 36.

The availability of thin film 38 in orifice sub-structure 12 for forming circuits, circuit elements and/or conductive paths dramatically increases the density with which circuits may be integrated into printhead structure 10. Also, as described in more detail below with reference to FIGS. 13 and 14, in addition to effectively doubling the area available for circuit integration between ink channels 30, conductors 42 in thin film 38 may cross over ink channels 30, thus allowing conductive paths extending both in an x direction parallel to ink channels 30 and in a y direction orthogonal to ink channels 30.

FIGS. 4-8 are elevation section views illustrating one embodiment of a method for fabricating printhead structure 10 shown in FIGS. 1-3. Conventional techniques well known to those skilled in the art of printhead fabrication and semiconductor processing may be used to carry out the methodology described below. Thus, details of those techniques are not included in the description. For example, semiconductor wafer processing in general, including printhead fabrication, often includes masking and etching. This process consists of creating a mask containing the pattern of the component to be formed and etching to remove the materials left unprotected by the mask. Photolithographic masking and etching, for example, is a common masking and etching technique. Other patterning techniques may be used in the selective removal of materials. Hence, the process may be referred to more generally as "patterning and etching." Although it is expected that the selective removal of materials will often involve patterning and etching, other selective removal processes could be used. References to patterning and etching, therefore, should not be construed to limit the processes that may be used for the selective removal of material. Also, each step in the fabrication sequence illustrated in FIGS. 4-8 may include multiple process steps, and the process steps used to form the desired structures as well as the order in which the steps are performed may vary from that shown.

Figure 4:
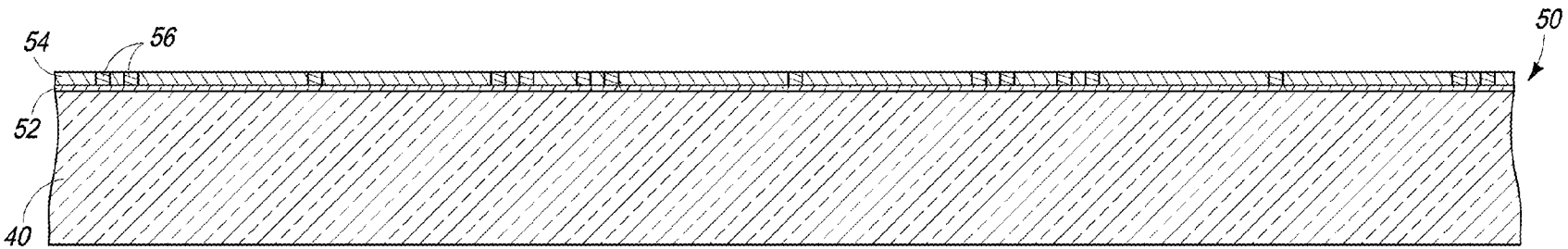
FIGS. 4-8 are elevation section views illustrating one embodiment of a method for fabricating a thermal inkjet printhead structure such as the one shown in FIGS. 1-3.

Referring first to FIG. 4, a thin film 50 is formed on orifice substrate 40. Thin film 50 is the precursor to thin film structure 38 shown in FIGS. 1-3. Accordingly, thin film 50 in FIG. 4 includes a conductive layer 52, an oxide or other suitable insulating layer 54 over conductive layer 52, and metal conductor bumps 56 embedded in insulating layer 54.

Figure 5:
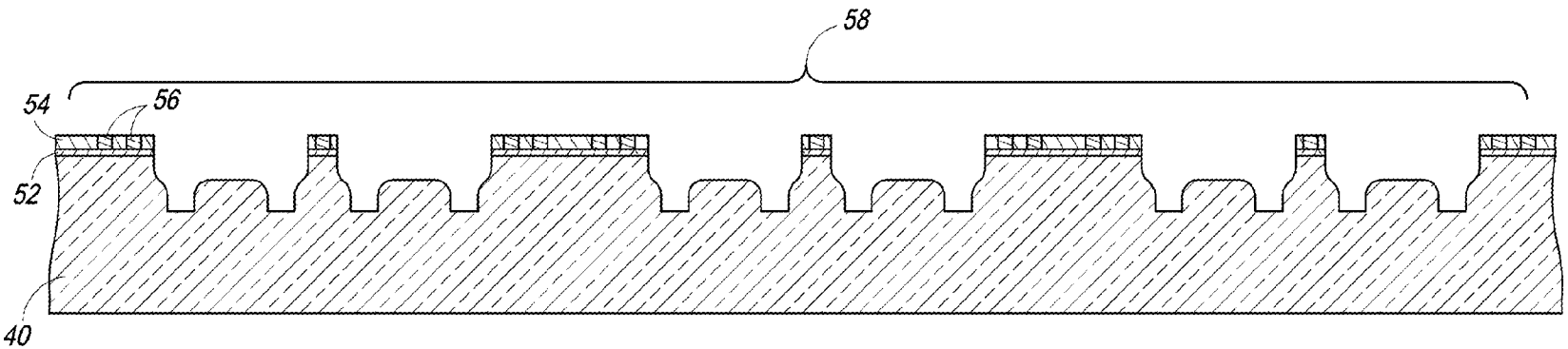
Figure 6:
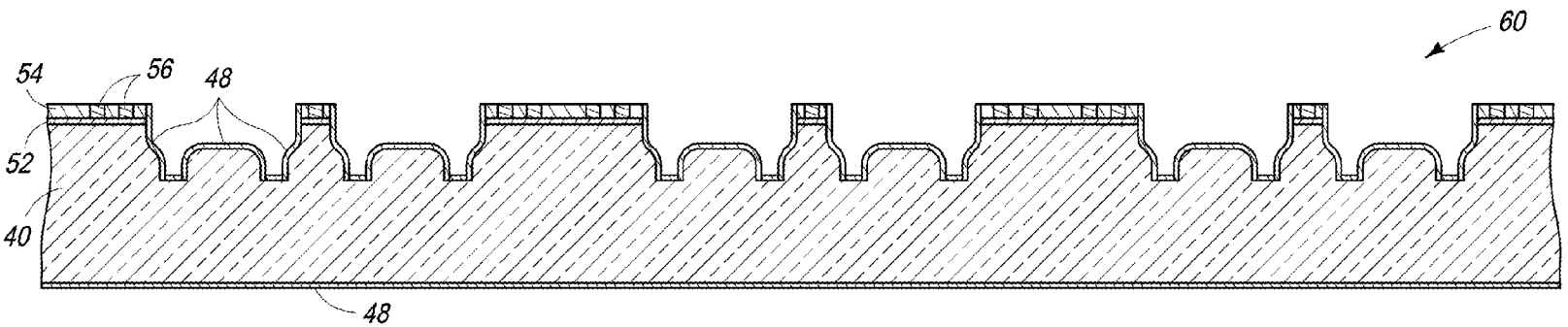

Referring to FIG. 5, thin film 50 and substrate 40 are patterned and etched along an orifice area 58 to form the desired configuration for firing chambers 34, orifices 36 and interface 15 shown in FIGS. 1-3. Depending on the material used for substrate 40, it may be necessary or desirable to form passivation layer 48 on substrate 40 along parts of orifice area 58 to inhibit corrosion from prolonged exposure to ink. For a silicon substrate 40, for example, passivation layer 48 may be formed by oxidizing the exposed outer surfaces of substrate 40 as shown in FIG. 6.

Figure 7:
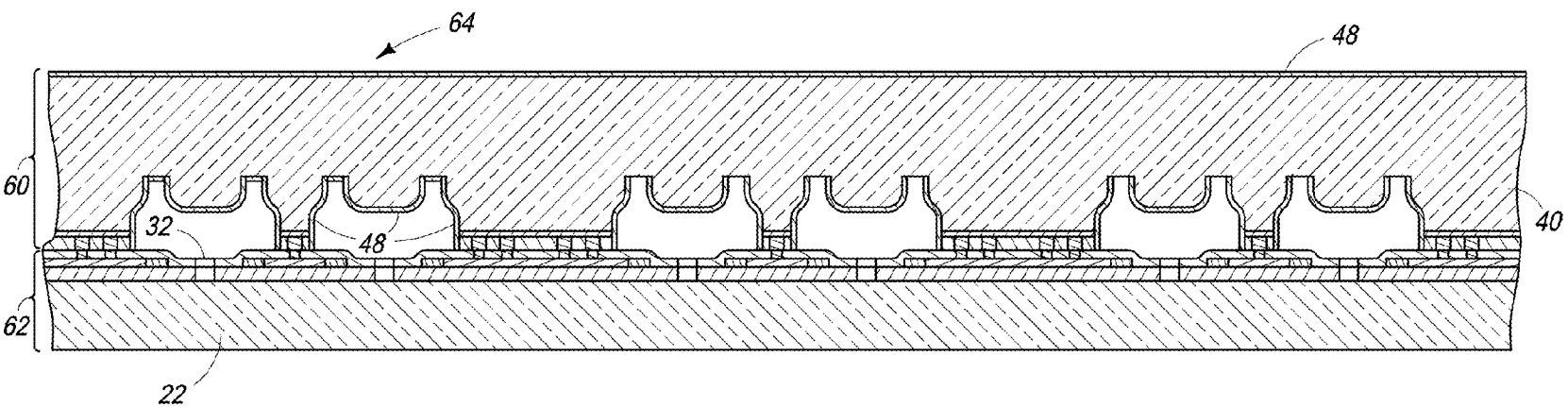

Referring to FIG. 7, in-process orifice sub-structure 60 and an in-process ejector element sub-structure 62 are aligned with one another and bonded together to form an in-process composite printhead structure 64. In the embodiment shown, in-process ejector element sub-structure 62 has been processed through the formation of ink channel openings 32 in thin film 20, but those parts of ink channels 30 in substrate 22 have not yet been formed. Also, orifice substrate 40 has not yet been thinned to open orifices 36. Although the formation of these structures might possibly be completed before bonding, it is expected that ink channels 30 in substrate 22 will usually be formed and orifices 36 in substrate 40 opened after bonding to preserve the structural integrity of substrates 22 and 40 during bonding. Processing the comparatively thick, more robust, substrates 22 and 40 shown in FIG. 7 may reduce the risk of damage during alignment and bonding operations.

Figure 8:
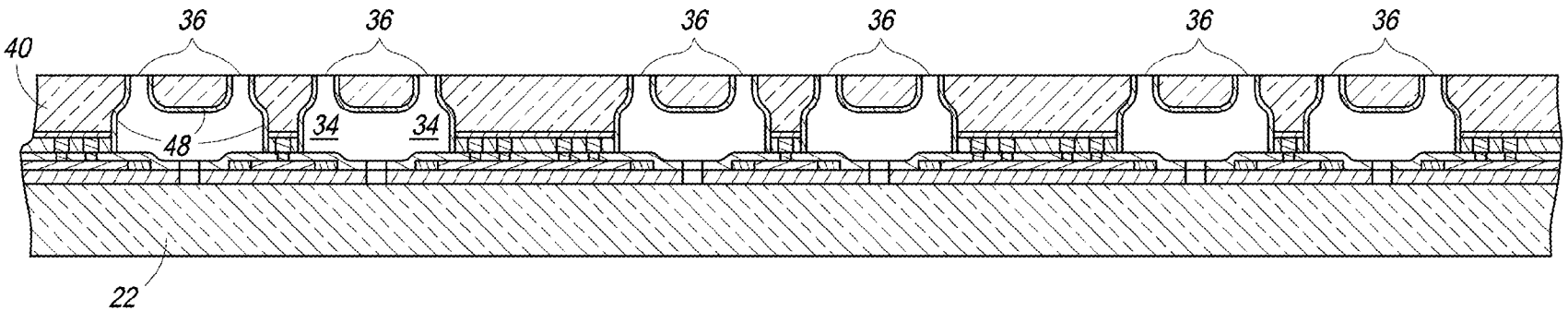

Referring to FIG. 8, orifice substrate 40 is thinned to open orifices 36 by, for example, back grinding substrate 40 to passivation layer 48 and then planarizing the top surface of substrate 40 through the thickness of layer 48. Alternatively, layer 48 may be etched off substrate 40 but not into the firing chambers 34, thus leaving a passivation layer 48 in those areas exposed to ink as shown in FIGS. 1-3 and 8. A cleaning step, rinsing with de-ionized water for example, may be necessary or desirable in some circumstances following back grinding to remove any waste particles. Referring back to FIG. 1, ejector substrate 22 may be thinned to a desired thickness by, for example, back grinding the silicon substrate 22 until reaching the desired thickness and then patterned and etched to complete the formation of ink channels 30. A temporary carrier wafer (not shown) may be used to facilitate the process of thinning substrate 22 and forming channels 30, as shown and described in application Ser. No. 12/205,709.

Referring again to FIGS. 1-3, interface 15 between sub-structures 12 and 14 includes bonding interface areas 16 where the primary structural bonds are made between sub-structures 12 and 14. As described in more detail in application Ser. No. 12/205,709, suitable direct contact bond interfaces at bonding areas 16 include oxide to oxide, oxide to silicon, and silicon to silicon. For example, TEOS insulating layers 28 and 44 in thin films 20 and 38, respectively, will provide suitable oxide to oxide direct contact bond interfaces 16. (TEOS refers to the deposition of silicon dioxide using a TetraEthylOrthoSilicate low temperature chemical vapor deposition process.) Silicon nitride, silicon carbide or other suitable dielectric materials may be used for insulating layers 28 and 44 depending on the desired direct contact bonding interface and/or passivation characteristics for layer 28.

One or both of layers 28 and 44 may be planarized at bonding interface areas 16 if necessary or desirable to provide flat, smooth bonding surfaces. A direct contact bond may be formed by, for example, low temperature plasma activated bonding, which is sometimes also referred to as plasma enhanced bonding. The use of low temperature plasmas of various ionized gases to enhance the bonding properties of bond surfaces for direct contact bonding is well known in the art of semiconductor processing. The inorganic covalent bonds bonding together the ejector and orifice sub-structures 12 and 14 in printhead structure 10 eliminate the problematic organic barrier and adhesive layers in conventional printheads that are susceptible to ink attack, thus providing a firing chamber solution with wide ink latitude that is largely inert to even aggressive solvents. Direct bonding fabrication techniques such as those described above, which are described in more detail in application Ser. No. 12/205,709, enable the low-temperature/low-stress wafer level attachment of a prefabricated dielectric orifice sub-structure and a nearly fully processed thermal ejector element sub-structure.

Interface 15 between sub-structures 12 and 14 also includes electrical interface areas 17 where electrical connections are made between sub-structures 12 and 14. Electrical connections may be made at interface areas 17, for example, using solder, metal compression bonding, or a conductive adhesive. Metal compression bonding may be used, for example, by forming protruding conductor bumps 29 in thin film 20 on ejector sub-structure 14 and/or protruding conductor bumps 46 in thin film 38 on orifice sub-structure 12 prior to bonding in FIG. 7, and then pressing the two sub-structures together under conditions sufficient to bond together the metal conductors 29 and 46. Alternatively, for another example, solder may be applied locally to one or both sub-structure surfaces at recessed conductors 29 and/or 46 and flowing the solder into the recess(es) to form the electrical interconnection between conductors 29 and 46. Depending on the characteristics of the bonding techniques used to form the electrical interconnection between conductors 29 and 46, the electrical interconnection may be formed simultaneously with or discrete from (before or after) forming the structural bonds at interface areas 16.

Figure 9:
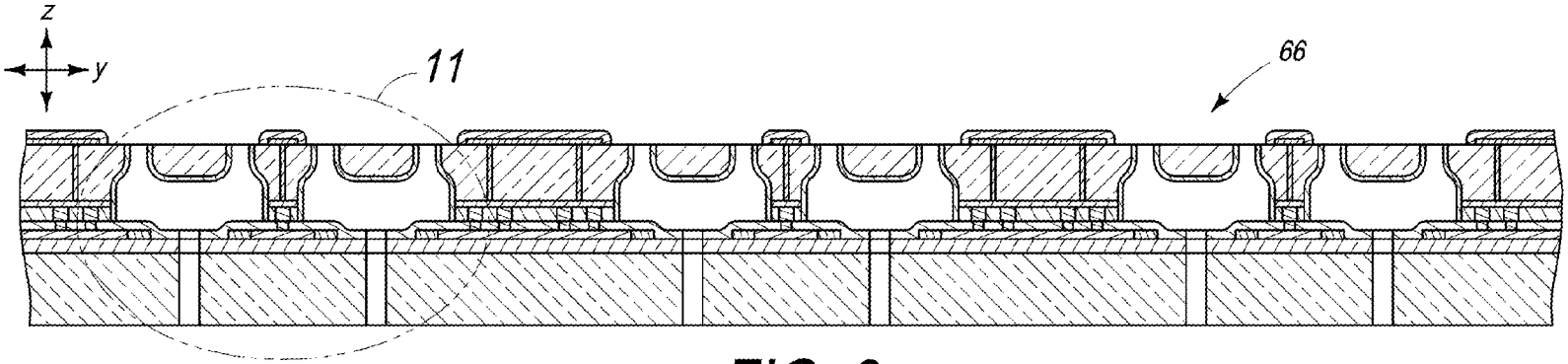
FIGS. 9 and 10 are elevation and perspective section views, respectively, illustrating a thermal inkjet printhead structure according to another embodiment of the disclosure.
Figure 11:
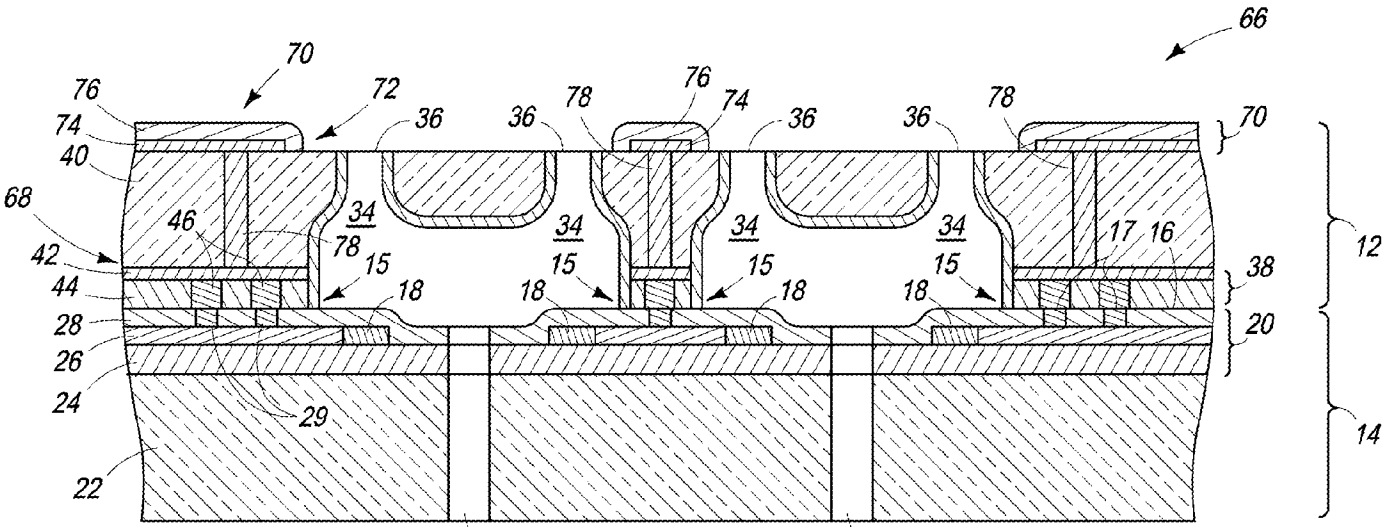
FIG. 11 is a detail section view of a portion of the printhead structure shown in FIG. 9.
Figure 10:
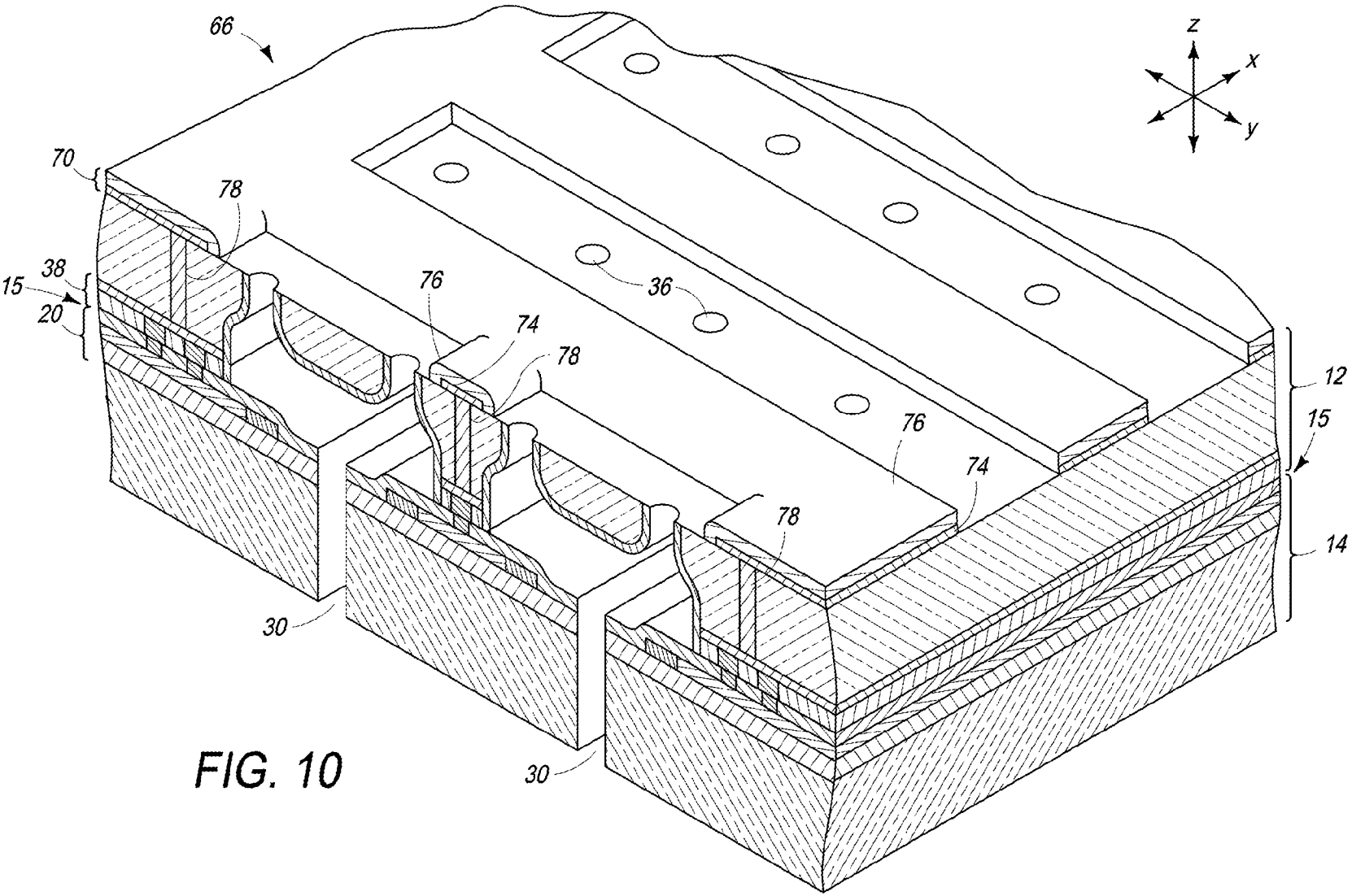

FIGS. 9-11 illustrate another embodiment of a printhead structure 66 in which conductors are formed along both the interior and exterior parts of orifice substrate 40. Printhead structure 66 is similar to printhead structure 10 shown in FIGS. 1-3. Thus, for convenience, the same part numbers are used to designate the same or similar components in both printhead structure 10 and printhead structure 66. Referring to FIGS. 9-11, printhead structure 66 is formed as a composite structure that includes an orifice sub-structure 12 and an ejector element sub-structure 14 bonded together along an interface 15. Interface 15 includes bonding interface areas 16 where the primary structural bonds are made between elements in sub-structures 12 and 14 and electrical interface areas 17 where electrical connections are made between elements in sub-structures 12 and 14.

Firing resistors 18 in ejector element sub-structure 14 are formed as part of a thin film structure 20 on substrate 22. In addition to firing resistors 18, thin film 20 in ejector element sub-structure 14 may include control and drive circuits (or circuit elements) for resistors 18, conductive paths for these circuits, and layers/films that electrically insulate the conductors from surrounding structures and help protect against contamination, corrosion and wear. Thus, thin film 20 shown in the figures is a simplified depiction of an actual thin film structure. In the embodiment shown, as best seen in FIG. 11, thin film 20 includes a field oxide layer 24 on substrate 22, conductive traces 26 to resistors 18, a passivation dielectric layer 28 over resistors 18 and conductive traces 26, and interconnection conductors 29 through passivation layer 28. Ink supply channels 30 in ejector element sub-structure 14 (including openings 32 through thin film 20) carry ink to firing chambers 34 associated with each firing resistor 18.

Orifice sub-structure 12 includes a thin film structure 38 on an interior part 68 of substrate 40 and a thin film structure 70 on an exterior part 72 of substrate 40. Thin films 38 and 70 in orifice sub-structure 12 may include control and drive circuits (or circuit elements) for resistors 18, conductive paths for these circuits, and layers/films that electrically insulate the conductors from surrounding structures and help protect against contamination, corrosion and wear. Thus, thin films 38 and 70 shown in the figures may reflect simplified depictions of actual thin film structures.

In the embodiment shown, thin film 38 includes conductor 42 on interior part 68 of substrate 40, an insulating layer 44 covering conductors 42, and interconnection conductors 46 through insulating layer 44. Thin film 70 includes conductors 74 on exterior part 72 of substrate 40 and an insulating layer 76 covering conductors 74. Interconnection conductors 78 extending through vias 80 in orifice substrate 40 connect the conductors in thin films 38 and 70. Orifice sub-structure 12 may also include a dielectric or other suitable passivation layer 48 along those areas exposed to ink, for example at firing chambers 34 and orifices 36.

Figure 12:
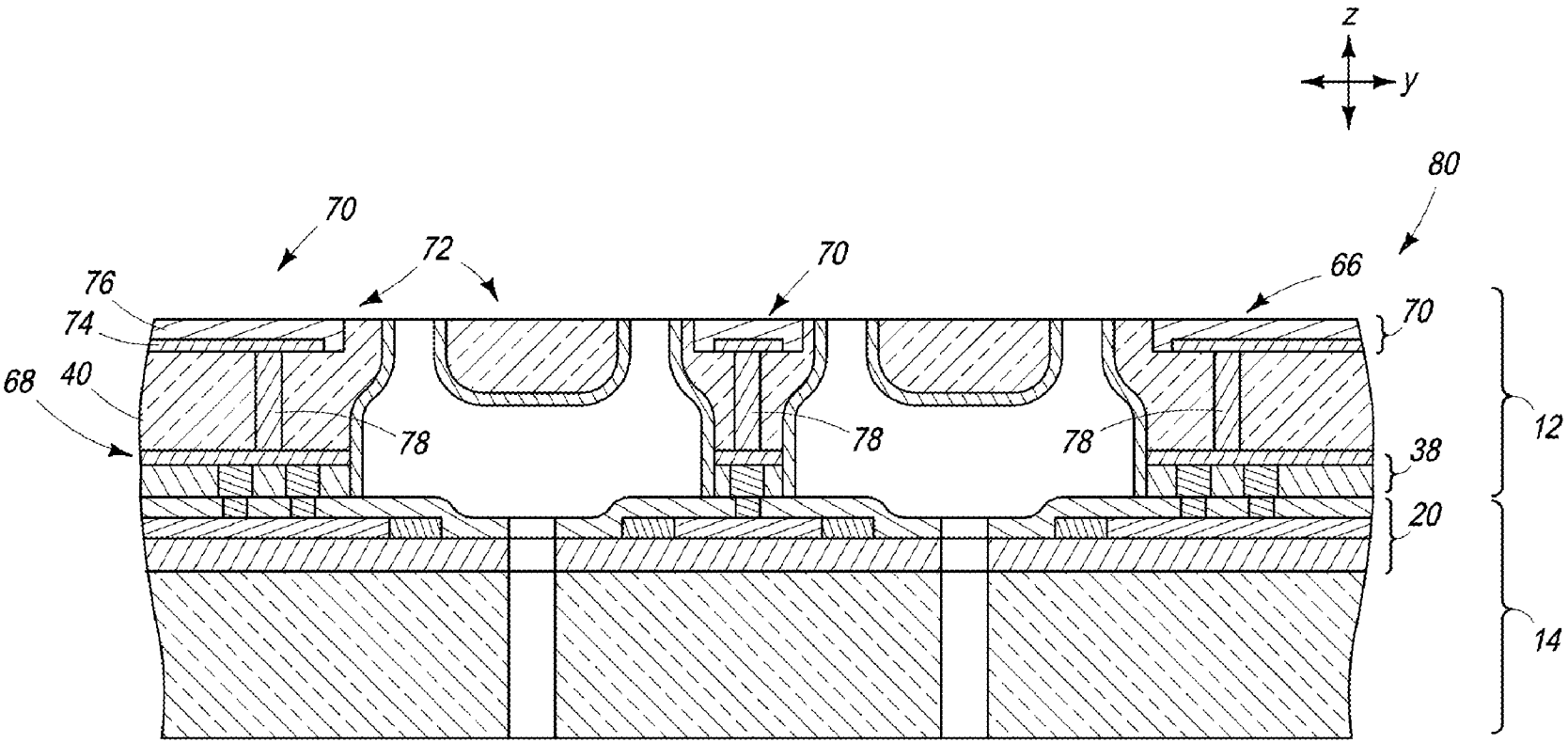
FIG. 12 is a section view of a printhead structure according to another embodiment of the disclosure.

FIG. 12 illustrates another embodiment of a printhead structure 80 in which a thin film 70 is embedded substrate 40, substantially flush with the surface along exterior part 72. Similarly, thin film 38 could be embedded in substrate 40, substantially flush with interior part 68.

Figure 13:
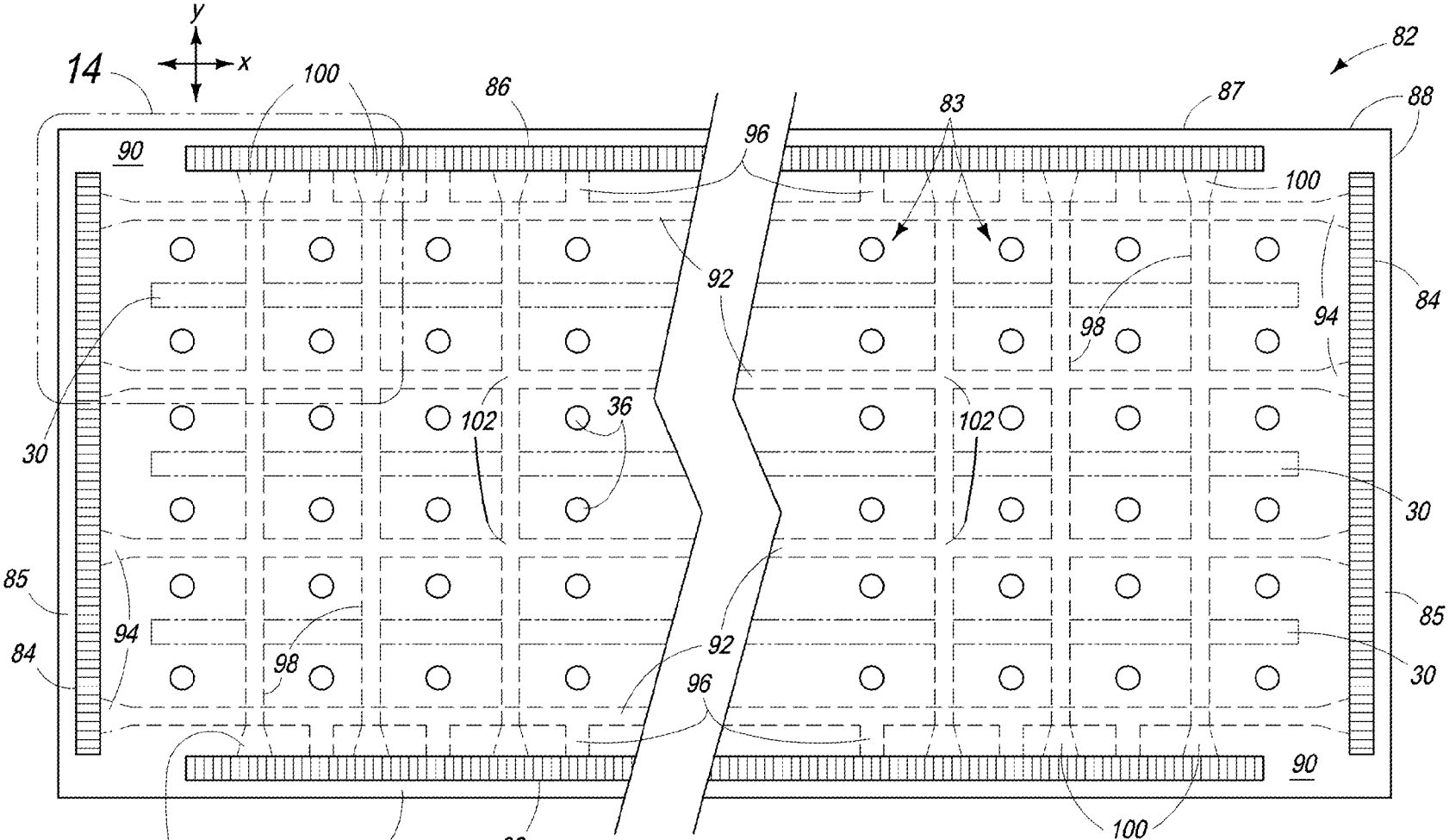
FIG. 13 is a plan view diagram illustrating the layout of an inkjet printhead according to an embodiment of the disclosure.
Figure 14:
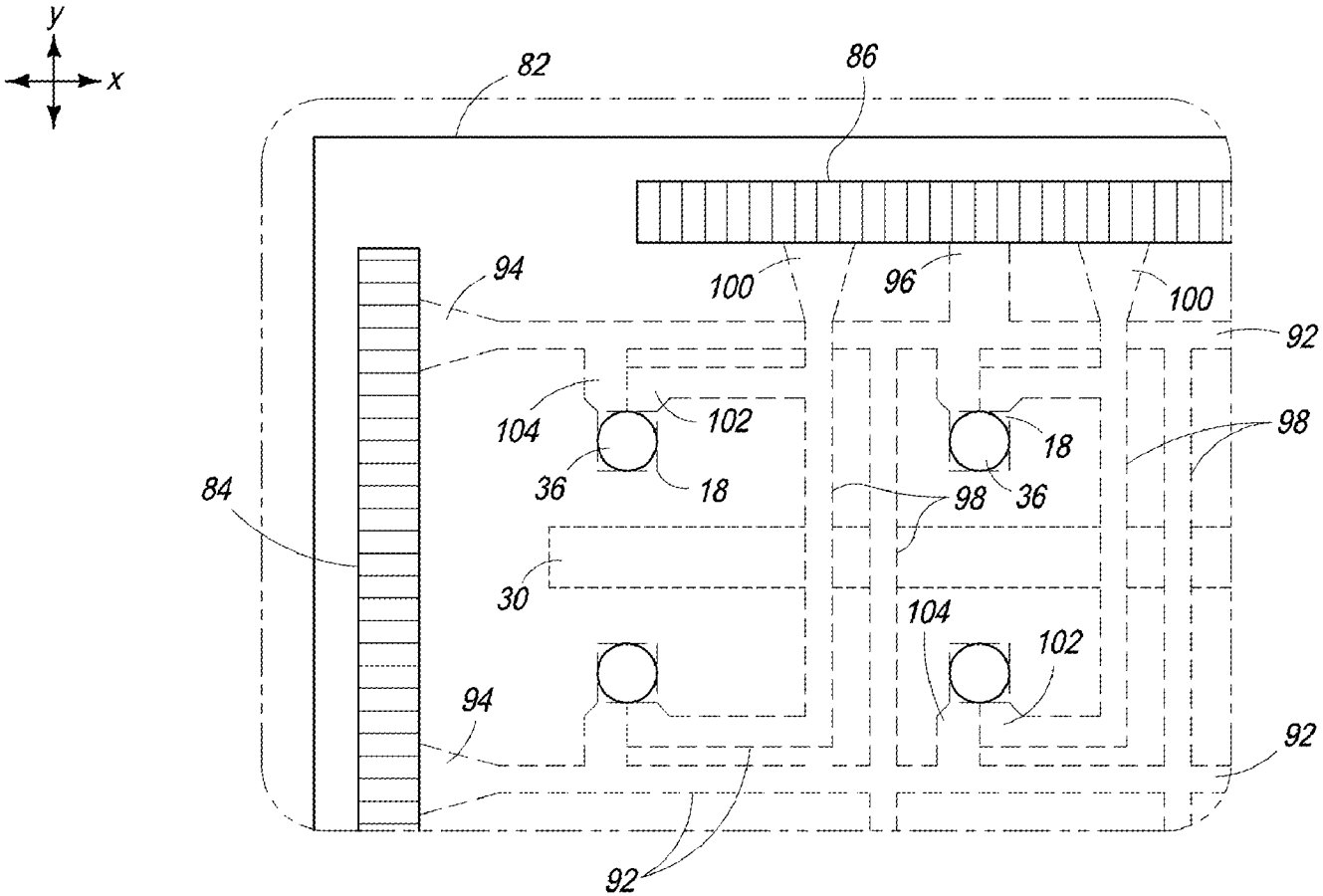
FIG. 14 is a detail view of a portion of the printhead layout shown in FIG. 13.

FIG. 13 is a plan view diagram illustrating one example of a conductor layout for an inkjet printhead 82 enabled by orifice sub-structure conductors such as those described above for printhead structures 10, 66 and 80. FIG. 14 is a more detailed view showing one example of a layout for control and drive circuit elements in printhead 82. FIGS. 13 and 14 are idealized depictions of example conductor layouts showing generally the paths some of the conductors follow on printhead 82. Again, for convenience, the same part numbers are used to designate the same or similar components in printhead 82 and printhead structures 10, 66 and 80.

Referring first to FIG. 13, printhead 82 includes an array 83 of orifices 36 arranged lengthwise in an x direction (corresponding to an x axis) and crosswise in a y direction (corresponding to a y axis) along orifice sub-structure 12 (FIG. 1). Ink supply channels 30 extend lengthwise in the x direction along ejector element sub-structure 14 (FIG. 1) between corresponding rows of orifices 36. Bond pads 84 and 86 are positioned along a perimeter 88 on both ends and both sides of printhead 82. Bond pads 84 designate the bonds pads that extend crosswise in the y direction along the ends 85 of printhead 82. Bond pads 86 designate the bond pads that extend lengthwise in the x direction along the sides 87 of printhead 82. Bond pads 84 and 86 are exposed at an exterior part 90 of printhead 82 for external electrical connections. External connections to printhead bond pads are typically made through a flexible tape (not shown) holding an array of conductive traces.

Conductor paths 92 in printhead 82 extend lengthwise in the x direction between rows of orifices 36 with connection paths 94 to bond pads 84 and connection paths 96 to bond pads 86. Conductor paths 98 in printhead 82 extend crosswise in the y direction over ink channels 30 between columns of orifices 36 with connection paths 100 to bond pads 86. The layout diagram of FIG. 13 also depicts electrical interconnection paths 102 between conductor paths 92 and 98 within the orifice array 83. Thus, resistor circuits in printhead 82 may utilize conductive paths 92 parallel to ink channels 30 to end bond pads 86 or conductive paths 98 crossing ink channels 30 to side bond pads 84 or a combination of both conductor paths 92 and 98 to bond pads 84 and/or 86. By contrast, in a conventional printhead in which conductive paths within the orifice array are formed only in the ejector element substrate, the resistor circuits must follow conductor paths parallel to the ink channels to end bond pads.

Paths 92-100 represent pathways for conductors not the conductors themselves. Conductors from different circuits may follow the same path. Interconnected paths shown in FIGS. 13 and 14, therefore, do not necessarily represent electrically connected conductors following those paths.

The layout diagram of FIG. 14 depicts one example of conductor paths for resistor control (logic) circuits 104 and resistor drive (power) circuits 106. Referring to FIG. 14 and to FIGS. 9-12, resistors 14, conductors 26, conductors 42, FET drive transistors and other elements (not shown) of circuits 104 and 106 formed in thin film 20 in ejector element sub-structure 14 may be connected to other circuit elements and to bond pads 84 and 86 through lengthwise, x axis conductor paths 92 formed in thin films 20 and/or 38 and crosswise, y axis conductor paths 98 formed in thin films 38 and/or 70. In the embodiment shown in FIG. 14, drive circuits 104 follow both x axis conductor paths 92 and y axis conductor paths 98 to end bond pads 84 at connection paths 94 and to side bond pads 86 at connection paths 96. Also, in the embodiment shown, control circuits 102 follow only a y axis conductor path 98 to side bond pads 86 at connection paths 100. This is just one example, however, of many different possible conductor path configurations. The new x-y axes conductors 42 and 74 in orifice sub-structure 12 and z axis interconnection conductors 29, 38 and 46 allow conductor paths from resistors 18 to bond pads 84, 86 along and over/across ink channels 30 in thin films 20, 38 and/or 70, thus allowing the printhead designer substantially greater flexibility in conductor layout compared to conventional printheads.

Figure 15:
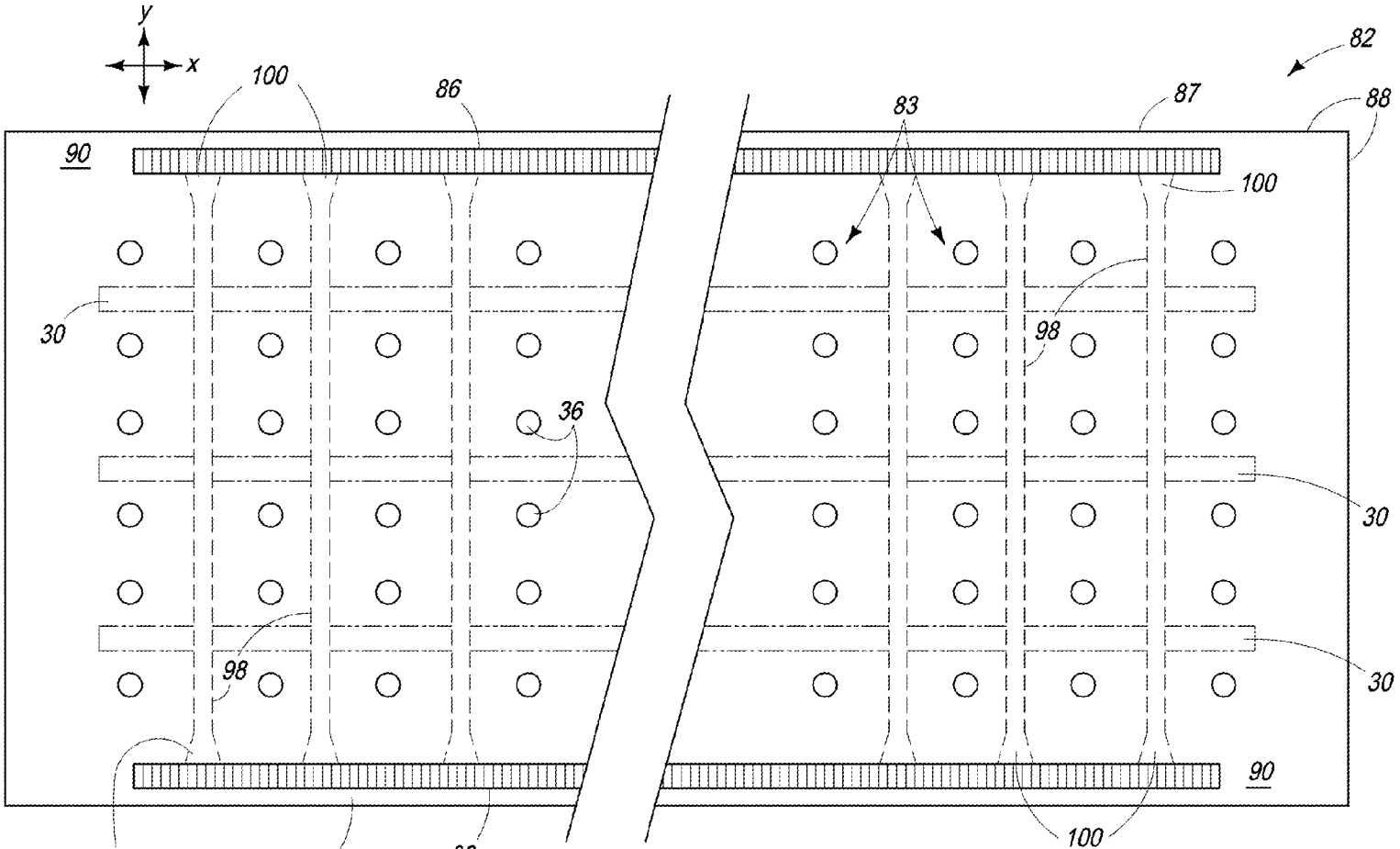
FIG. 15 is a plan view diagram illustrating the layout of an inkjet printhead according to another embodiment of the disclosure.

FIG. 15 is a plan view diagram illustrating a second example of a conductor layout for an inkjet printhead 82 enabled by orifice sub-structure conductors such as those described above for printhead structures 10, 66 and 80. In this example, only bond pads 86 extending lengthwise in the x direction along the sides 87 of printhead 82 are used for external circuit connections to y direction conductor paths 98. Conductor paths 98 in printhead 82 extend crosswise in the y direction over ink channels 30 between columns of orifices 36 with connection paths 100 to bond pads 86.

Figure 16:
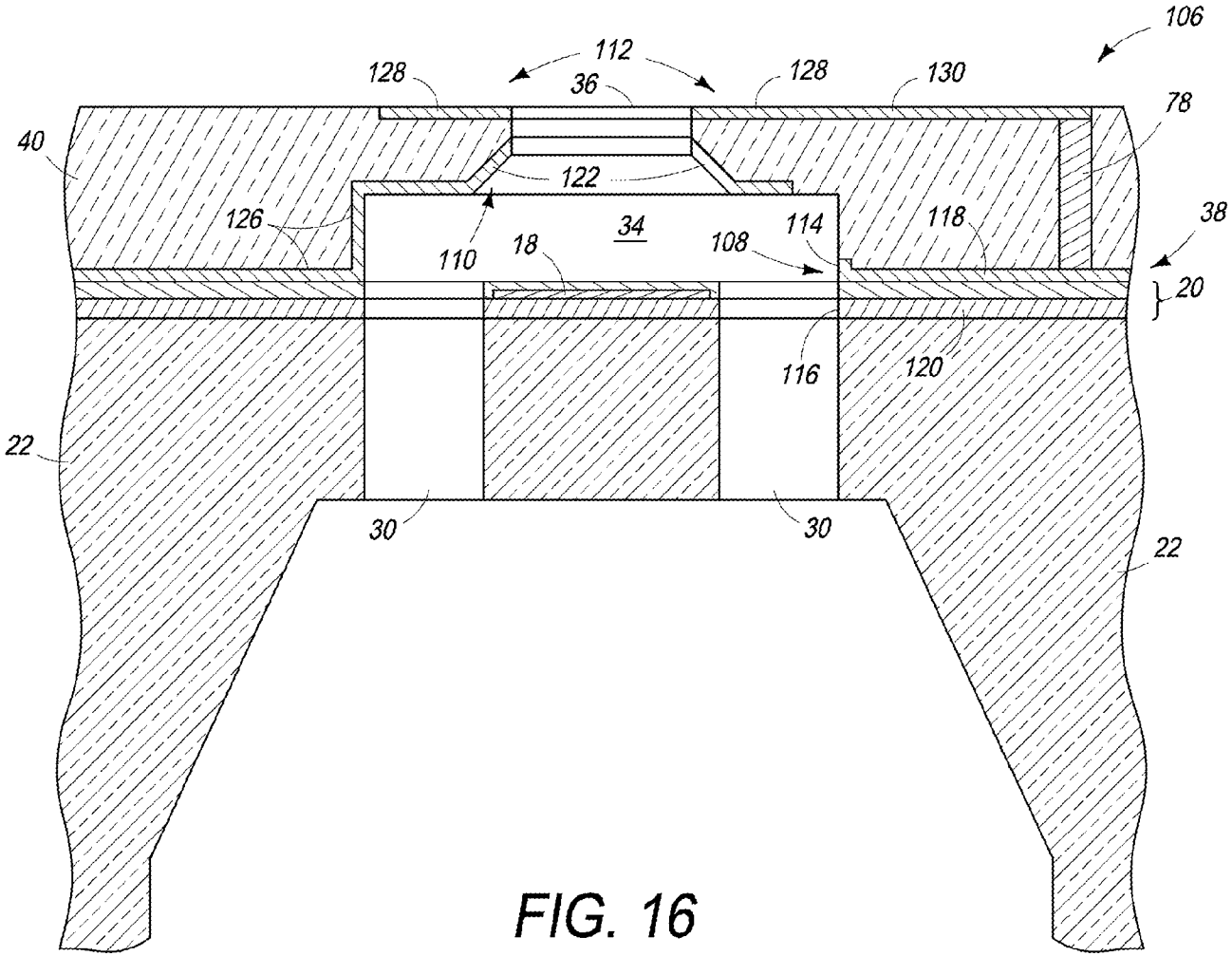
FIG. 16 is a section view illustrating a printhead structure according to another embodiment of the disclosure.

FIG. 16 is a section view illustrating a printhead structure 106 that includes additional functionality enabled by orifice sub-structure conductors such as those described above for printhead structures 10, 66 and 80. Again, for convenience, the same part numbers are used to designate the same or similar components in printhead structure 106 and printhead structures 10, 66 and 80. Referring to FIG. 15, printhead structure 106 includes drop detection circuitry 108, drop deflector circuitry 110 and thermal sensor circuitry 112. Drop detection circuitry 108, for example, may be configured as a capacitive circuit that includes capacitor electrodes 114 and 116 exposed to firing chamber 34 near an ink supply channel 30. In the embodiment shown, capacitor electrode 114 and a connecting lead 118 are formed in an ejector sub-structure thin film 20 and capacitor electrode 116 and a connecting lead 120 are formed in an orifice sub-structure thin film 38.

Drop deflector circuitry 110, for example, may be configured as a resistive circuit that includes a resistor 122 exposed to firing chamber 34 near orifice 36 to influence the characteristics of ink drops expelled from chamber 34. In the embodiment shown, resistor connecting leads 124 and 126 are formed along the interior of firing chamber 34 and in orifice sub-structure thin film 38. (That portion of connecting lead 126 extending in the x direction, into the sheet toward the back of chamber 34, and in the z direction down to thin film 38 is not visible in the section view of FIG. 15.)

Thermal sensor circuitry 112, for example, may be configured as a resistive circuit that includes a resistor 128 embedded in or formed on exterior 72 of orifice sub-structure 12 around orifice 36. A resistor connecting lead 130 is formed along orifice sub-structure exterior 72, down through orifice sub-structure 12 to thin film 38. (A second resistor connecting lead for circuitry 112 is not shown.) Alternatively, resistive circuitry 112 may be configured to function as a so-called "puddle breaker" to help remove ink residue from exterior part 72 of orifice sub-structure 12.

Although thin film 38 is represented generally by a single conductive layer in FIG. 15, thin film 38 may be configured as one or more conductive and insulating layers that will include multiple discrete conductors/traces for each of leads 118 and 120, 124 and 126, 130 and other circuit elements having conductive paths through thin film 38.

As used in this document, forming one part "over" another part does not necessarily mean forming one part above the other part. A first part formed over a second part means the first part formed above, below and/or to the side of the second part depending on the orientation of the parts. Also, "over" includes forming a first part on a second part or forming the first part above, below or to the side of the second part with one or more other parts in between the first part and the second part.

As noted at the beginning of this Description, the example embodiments shown in the figures and described above illustrate but do not limit the disclosure. Other forms, details, and embodiments may be made and implemented. Therefore, the foregoing description should not be construed to limit the scope of the disclosure, which is defined in the following claims.

What is claimed is:

1. A fluid ejector structure, comprising:

an array of fluid ejector elements in a first sub-structure;

an array of fluid ejection orifices in a second sub-structure bonded to the first sub-structure along an interface, each orifice in the array positioned adjacent to a corresponding one of the fluid ejector elements; and a three dimensional array of conductors within the orifice and ejector element arrays interconnected across the interface.

2. The structure of claim 1, wherein conductors in the conductor array are electrically connected to ejector elements in the ejector element array.

3. The structure of claim 1, wherein:

the ejector elements are arrayed in a first x-y plane;

the orifices are arrayed in a second x-y plane spaced apart from the first x-y plane; and the array of interconnected conductors includes first conductors connected to the ejector elements along the first x-y plane, second conductors along the second x-y plane, and third conductors extending in a z direction across the interface connecting the first conductors and the second conductors.

4. The structure of claim 1, further comprising:

an array of fluid ejection chambers, each chamber in the array associated with an ejector element and a corresponding ejection orifice such that a drop of fluid may be ejected from the chamber through the orifice at the urging of the ejector element; and one or more of:

drop detection circuitry connected to conductors in the conductor array, the drop detection circuitry having circuit elements within one or more of the fluid ejection chambers;

drop deflector circuitry connected to conductors in the conductor array, the drop detection circuitry having circuit elements within one or more of the fluid ejection chambers;

thermal sensor circuitry connected to conductors in the conductor array, the thermal sensor circuitry having circuit elements within the orifice array; and puddle breaker circuitry connected to conductors in the conductor array, the puddle breaker circuitry having circuit elements within the orifice array.

5. A fluid ejector structure, comprising an orifice sub-structure and an ejector element sub-structure bonded together along an interface, the orifice sub-structure including:

a plurality of orifices therein each positioned adjacent to a corresponding one of a plurality of fluid ejector elements on the ejector element sub-structure; and a plurality of first conductors in the orifice sub-structure at the interface, the first conductors connected to a corresponding plurality of second conductors in the ejector element sub-structure.

6. The structure of claim 5, wherein the first conductors are formed in a first thin film on the orifice sub-structure at the interface and the second conductors are formed in a second thin film on the ejector element sub-structure at the interface.

7. The structure of claim 5, wherein the orifice sub-structure also includes a plurality of third conductors along an exterior part of the orifice sub-structure opposite the interface, the third conductors connected to the first conductors.

8. The structure of claim 7, wherein the orifice sub-structure also includes a plurality of fourth conductors extending through the orifice sub-structure connecting the first conductors and the third conductors.

9. A fluid ejector structure, comprising:

an orifice sub-structure and an ejector element sub-structure bonded together along a generally x-y planar interface;

a plurality of fluid ejector elements arrayed on the ejector element sub-structure lengthwise in the x direction and crosswise in the y direction;

a plurality of elongated fluid supply channels in the ejector element sub-structure each extending lengthwise in an x direction between rows of fluid ejector elements;

a plurality of orifices arrayed in the orifice sub-structure lengthwise in the x direction and crosswise in the y direction, each orifice positioned adjacent to a corresponding one of the fluid ejector elements and each orifice operatively connected to a fluid supply channel such that fluid can flow from the fluid supply channel over a fluid ejector element to the orifice; and a plurality of conductors each having a first part in the elector element sub-structure connected to a fluid ejector element, a second part in the orifice sub-structure extending in the y direction over and across a fluid supply channel, and a third part in the orifice sub-structure extending in a z direction connecting the first and second parts.

* * * * *